US007544159B2

(12) United States Patent
Petratto

(10) Patent No.: US 7,544,159 B2
(45) Date of Patent: Jun. 9, 2009

(54) MACHINE FOR PRODUCING ARTICLES OF SHEET MATERIAL

(76) Inventor: Giorgio Petratto, Via Guarino Guarini, 50, 10078 Venaria Reale (IT)

( * ) Notice: Subject to any disclaimer, the term of this patent is extended or adjusted under 35 U.S.C. 154(b) by 0 days.

(21) Appl. No.: 11/943,843

(22) Filed: Nov. 21, 2007

(65) Prior Publication Data

US 2008/0121011 A1 May 29, 2008

(30) Foreign Application Priority Data

Nov. 24, 2006 (IT) ..... TO2006A0836

(51) Int. Cl.
*B31B 1/00* (2006.01)

(52) U.S. Cl. ..... 493/68; 493/71; 493/79; 493/405; 493/356

(58) Field of Classification Search ..... 493/68, 493/71, 72, 73, 76, 79, 151, 405, 400, 356, 493/144, 126

See application file for complete search history.

(56) References Cited

U.S. PATENT DOCUMENTS

| | | | | |
|---|---|---|---|---|
| 3,749,394 | A * | 7/1973 | McCain et al. | 493/406 |
| 3,897,051 | A * | 7/1975 | Muller | 270/43 |
| 3,980,290 | A * | 9/1976 | Sjoman et al. | 493/439 |
| 5,014,582 | A * | 5/1991 | Teik | 83/24 |
| 5,344,379 | A * | 9/1994 | Garrone | 493/441 |
| 5,540,647 | A * | 7/1996 | Weiermann et al. | 493/444 |
| 6,309,336 | B1 * | 10/2001 | Muessig et al. | 493/444 |
| 6,565,499 | B2 * | 5/2003 | Benzoni | 493/199 |
| 6,612,974 | B2 * | 9/2003 | Hooper | 493/413 |
| 6,981,939 | B2 * | 1/2006 | Petratto | 493/405 |

FOREIGN PATENT DOCUMENTS

EP 1 424 191 A2 * 6/2004

* cited by examiner

*Primary Examiner*—Sameh H. Tawfik
(74) *Attorney, Agent, or Firm*—Berenato, White & Stavish, LLC.

(57) ABSTRACT

A machine for producing articles of sheet material, having a conveyor with powered rollers for feeding blanks along a path; pressure devices for holding the blanks in contact with the powered rollers; and operating devices which interact with the blanks to perform operations, in particular folding and gluing operations, on the blanks as the blanks travel along the path. The conveyor has a number of drive members arranged along the path, and to which the pressure devices are connectable by universal transmission assemblies.

14 Claims, 4 Drawing Sheets

MACHINE FOR PRODUCING ARTICLES OF SHEET MATERIAL

The present invention relates to a machine for producing articles of sheet material, e.g. folders, CD jackets, pamphlets, book-covers, etc., from flat blanks.

BACKGROUND OF THE INVENTION

Machines of the above type are known, in which the blanks are fed along a given path on a conveying surface, and interact with operating devices, such as folding, gluing or pressing devices, arranged successively along the path.

The conveying surface may comprise one or more belts, or a number of side by side powered rollers with respective axes crosswise to the path. Whichever the case, the blanks, as they are fed forward, must be maintained contacting the conveyor belts or rollers at all times, which is normally done using pressure devices comprising a number of idle rollers or wheels.

EP-A-1 424 191 describes a machine comprising a powered-roller conveying surface; and a number of operating devices and idle-roller pressure devices, which are supported over the machine frame by gantry-type supporting members to permit flexible placement along the path.

Using a combination of powered rollers and accurately but flexibly supported pressure devices provides for conveying the blanks accurately with no lateral slip.

In known machines of the above type, however, a certain amount of slippage still remains between the blanks and the conveyor rollers, and which known pressure devices fail to eliminate.

SUMMARY OF THE INVENTION

It is an object of the present invention to provide a machine as claimed in the attached claims, and designed to eliminate the drawbacks typically associated with known machines.

According to the present invention, there is provided a machine as claimed in the attached Claims.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
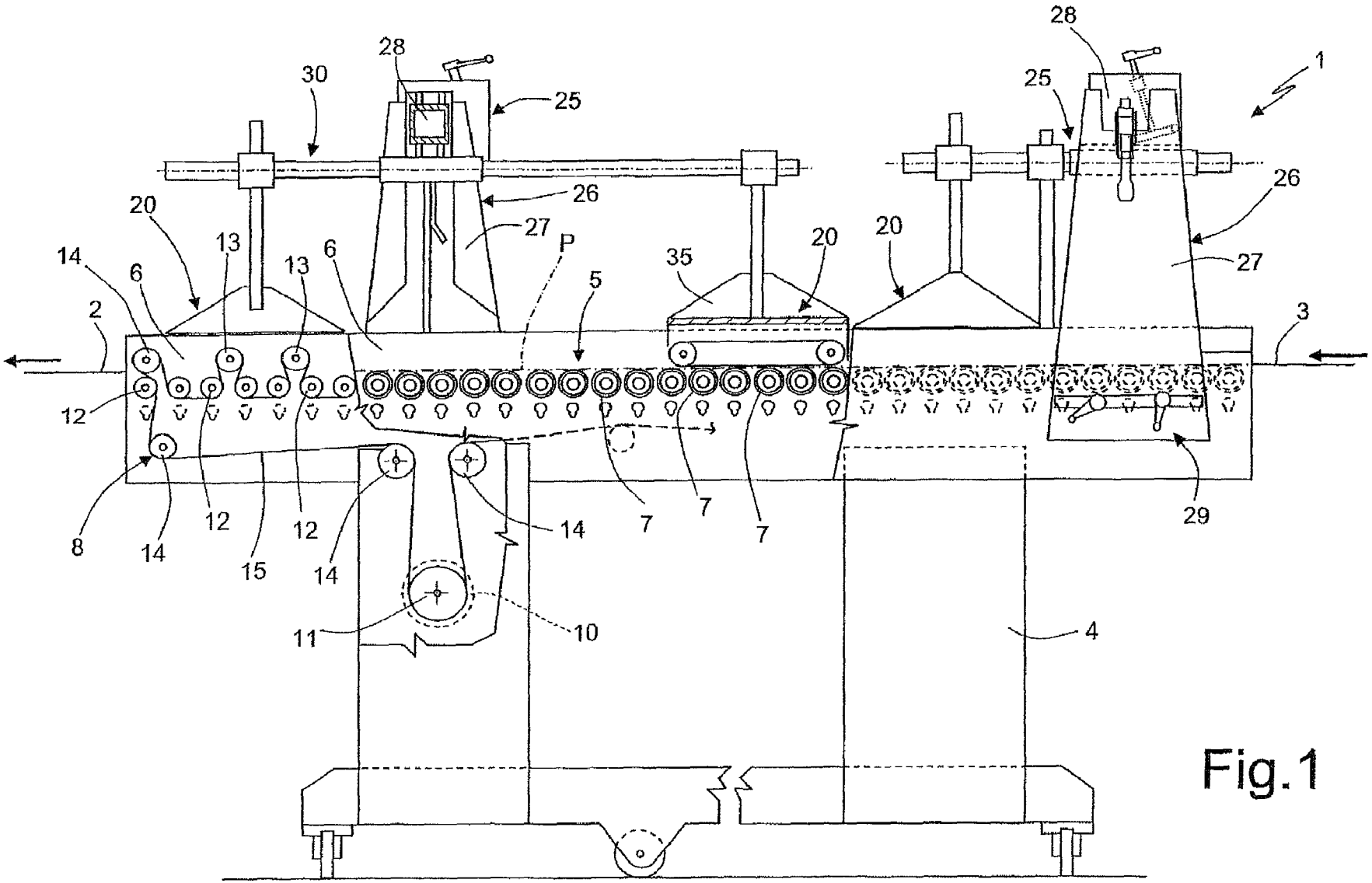
FIG. 1 shows a side view of a machine in accordance with the present invention.

Number 1 in FIG. 1 indicates as a whole a machine for producing articles 2 of sheet material from blanks 3.

Machine 1 comprises a supporting structure 4 supporting a powered-roller conveyor 5 for feeding blanks 3 along a straight horizontal path P.

Conveyor 5 comprises two fixed shoulders 6 fitted to supporting structure 4, parallel to each other and to path P, and spaced apart perpendicularly to path P; and a number of rollers 7 extending between shoulders 6, with their axes perpendicular to path P and equally spaced horizontally. Rollers 7 are fitted in rotary manner to shoulders 6 by means of bearings not shown, and are connected rotationally to one another by a powered belt drive 8.

More specifically, drive 8 is powered by an electric motor 10 housed in supporting structure 4, and comprises a drive pulley 11 powered by motor 10; a number of driven pulleys 12, equal in number to rollers 7, and each of which is coaxial with, and connected rigidly to one end of, a respective roller (FIGS. 2 and 5); and a number of idle pulleys 13, 14, which, together with pulleys 11 and 12, define an endless path for a belt 15.

Figure 2:
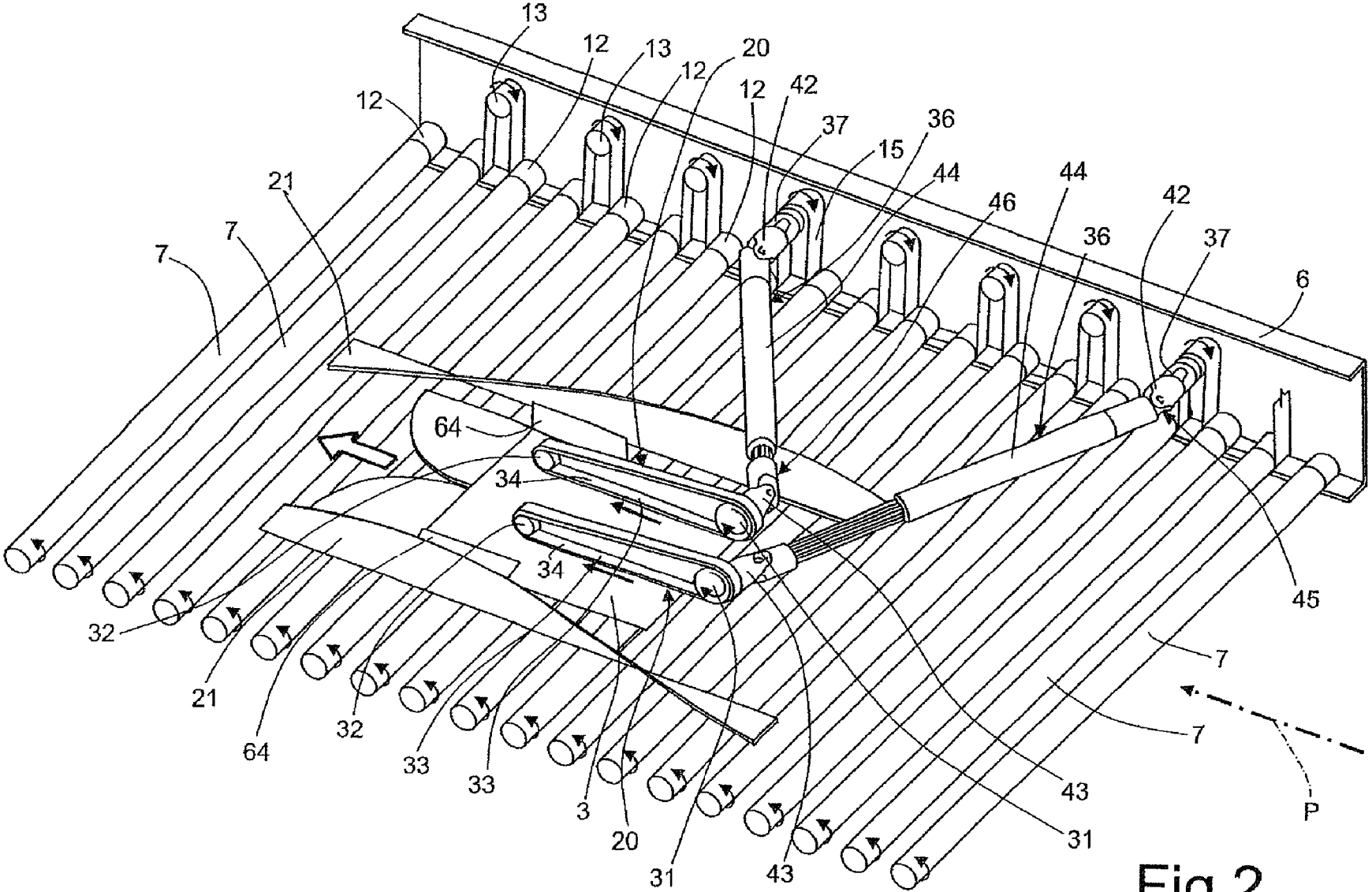
FIG. 2 shows a schematic, partial view in perspective of a first example of a work station of the FIG. 1 machine.
Figure 5:
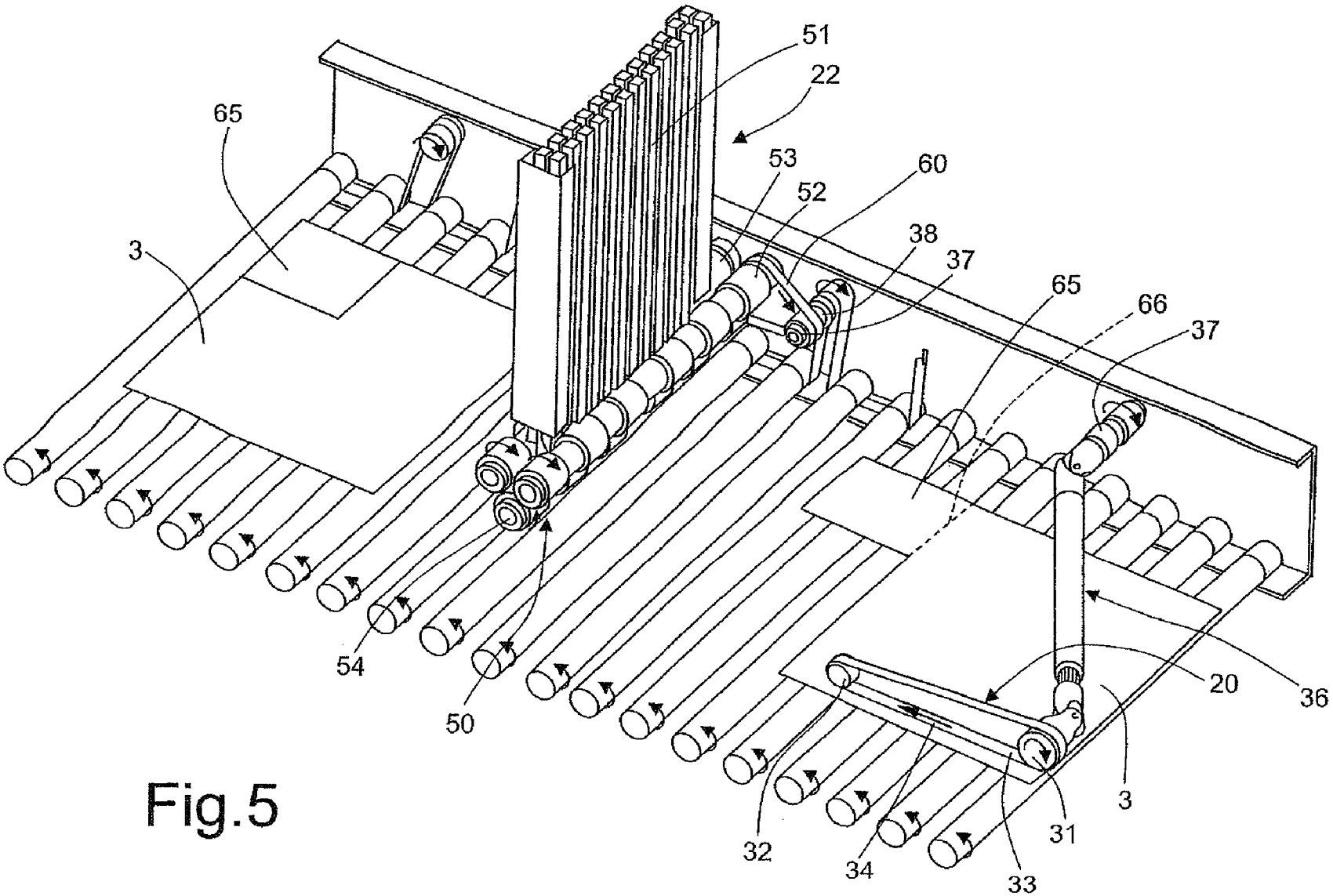
FIG. 5 shows a schematic, partial view in perspective of a second example of a work station of the FIG. 1 machine.

More specifically, pulleys 13 are fitted to one of shoulders 6, are located above driven pulleys 12, and are equally spaced with twice the spacing of driven pulleys 12, so that each pulley 13 is located along the centreline between two pulleys 12 (FIGS. 2 and 5). This arrangement ensures sufficient looping of the belt about pulleys 12 and 13 to prevent slippage.

Pulleys 14, which are fewer in number, are located at the ends of and beneath the active branch of belt 15 cooperating with pulleys 12 and 13, and define a return branch of belt 15.

Rollers 7 define a conveying surface for blanks 3; and conveyor 5 is equipped with pressure devices 20, which interact with the blanks to hold them on rollers 7 and prevent slippage.

Pressure devices 20, described in detail below, are arranged along path P so that each blank always interacts with at least one pressure device, and is therefore never allowed to slip with respect to rollers 7.

Machine 1 may be equipped with one or more known operating devices, which may differ in number, location, and design, and through which blanks 3 are fed by conveyor 5.

More specifically, FIG. 2 shows two helical folding devices 21 for making respective longitudinal folds in blanks 3.

FIG. 5 shows a pocket folding assembly 22 for making transverse folds.

Pressure devices 20 and operating devices 21, 22 are supported on the conveying surface by a number of supporting assemblies 25 not described in detail here, by not forming part of the present invention, but which are described in EP-A-1 424 191, which is included herein by way of reference.

Very briefly, supporting assemblies 25 comprise a gantry frame 26 in turn comprising two uprights 27 and a cross member 28. Uprights 27 are each fixed to a respective shoulder 6, so that cross member 28 extends crosswise over the conveying surface; and uprights 27 can be fixed to shoulders 6 in predetermined discrete positions, preferably by means of fast-fit fastening means 29 as described in EP-A-1 424 191.

Pressure and operating devices 20, 21 are suspended from cross member 28 by a bar system 30 as described in EP-A-1 424 191.

More specifically, each pressure device 20 comprises two side by side pulleys 31, 32 spaced apart in the direction of path P, and having axes parallel to each other and to the axes of rollers 7. An endless belt 33 is looped about pulleys 31, 32 to define a bottom branch 34, which lies substantially on the conveying surface of conveyor 5, and cooperates with a top face of blanks 3 travelling along rollers 7. Pulleys 31, 32 are supported by a frame 35 (FIG. 1)—omitted in FIGS. 2 and 5 for the sake of clarity—in turn suspended from a cross member 28 by bar system 30.

Figure 3:
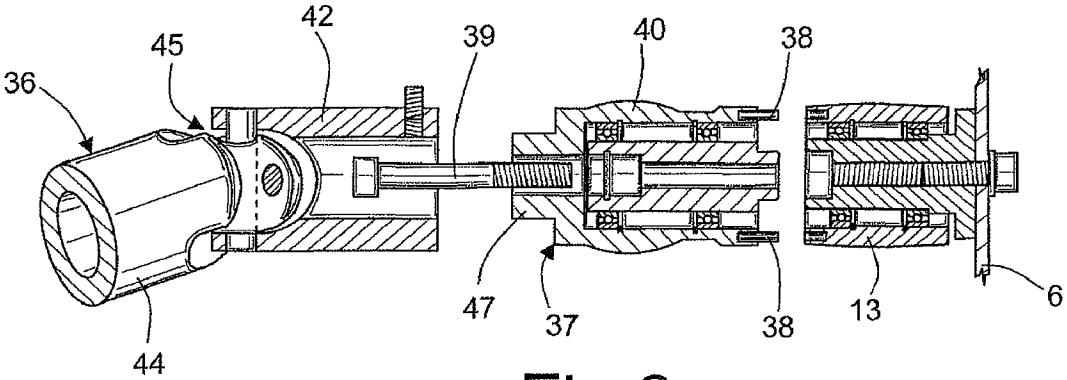
FIG. 3 shows a partly sectioned, exploded detail of FIG. 2.
Figure 4:
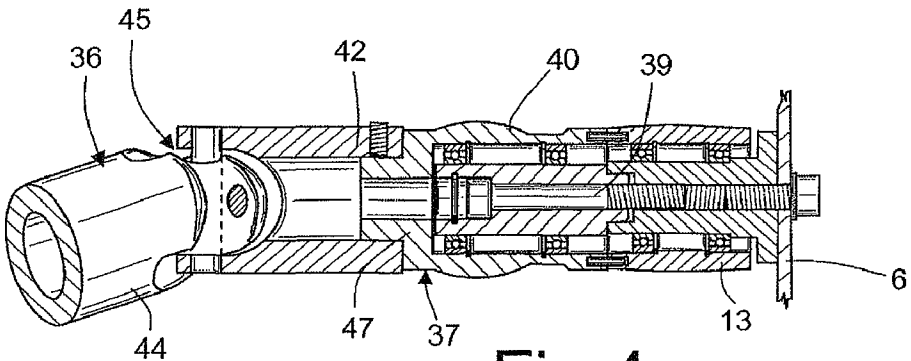
FIG. 4 shows a partly sectioned view of the FIG. 2 detail assembled.

Pulley 31 of each pressure device is connected to an idle pulley 13 of drive 8 by a universal transmission assembly 36 and a coupling 37. Coupling 37, shown in detail in FIGS. 3 and 4, fits at one end to idle pulley 13, is connected in angularly fixed manner to idle pulley 13 by two pins 38, is locked axially by an axial screw 39, and has a convex intermediate portion 40, which may act as a pulley to belt-drive an accessory, as described below.

Universal transmission assembly 36 substantially comprises two end couplings 42, 43; and a telescopic intermediate member 44 connected to end couplings 42, 43 by respective universal joints 45, 46. A first end coupling 42 is fixed at one end to coupling 37 which, for this purpose, has a tubular projection 47 which fits inside coupling 42; and a second end coupling 43 is fixed rigidly to pulley 31 of a pressure device 20.

Figure 6:
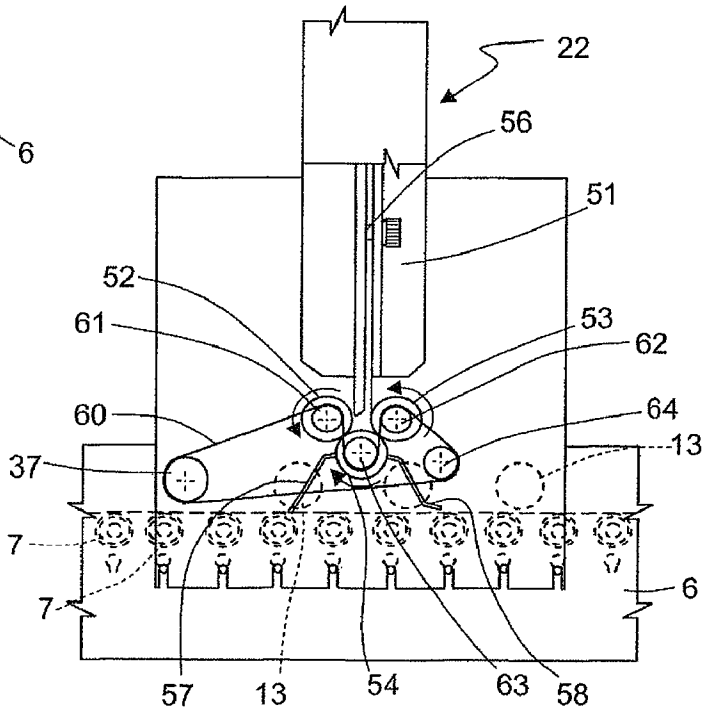
FIG. 6 shows a schematic, partly sectioned side view of the FIG. 5 work station.

With reference to FIGS. 5 and 6, pocket folding assembly 22 substantially comprises in known manner a bottom roller unit 50 and a top folding pocket 51. Roller unit 50 comprises three rollers 52, 53, 54, with axes parallel to the axes of rollers 7: two side by side, horizontally spaced top rollers 52, 53; and a bottom roller 54, which extends along the centreline of top rollers 52, 53, is located vertically between rollers 7 and rollers 52, 53, and contacts rollers 52, 53 to define, with each, a pair of traction rollers for blanks 3. Pocket 51 extends vertically above rollers 52, 53, and has an adjustable inner stop 56 for arresting the blanks at a predetermined height. Two guide members 57, 58, shown schematically in FIG. 6, guide blanks 3 in and out of pocket folding assembly 22. Guide member 57 raises the leading edge of the blank to guide it between rollers 52 and 54 to pocket 51, where the leading edge is arrested by stop 56, while an intermediate portion of blank 3, the portion to be folded, is fed between and folded by rollers 53 and 54. The folded blank is then guided by guide member 58 onto the roller conveying surface.

FIG. 6 also shows schematically the transmission system for transmitting motion from drive 8 of the machine to rollers 52, 53, 54 of pocket folding assembly 22. This is done by means of a belt 60 driven by the pulley portion 40 of a coupling 37 fixed to an idle pulley 13 of drive 8 as described above. Belt 60 cooperates with driven pulleys 61, 62, 63 integral with respective rollers 52, 53, 54 of the pocket folding assembly, cooperates with an idle pulley 64 located on the opposite side of driven pulleys 61, 62, 63 to coupling 37, and winds over pulleys 61, 62 and underneath pulley 63 to rotate rollers 52, 53 in the same direction as coupling 37 (and therefore in the opposite direction to rollers 7), and to rotate roller 54 in the opposite direction.

FIGS. 2 and 5 show two examples of operations performable on machine 1.

In FIG. 2, two helical folding devices 21 longitudinally fold respective tabs 64 of a blank 3.

In FIG. 5, a pocket folding device 22 folds a portion 65 of a blank 3 along a transverse fold line 66 preferably formed beforehand.

A wide range of other operations may obviously be performed using other operating devices on machine 1.

The advantages of machine 1 according to the present invention will be clear from the above description.

Using pulleys 13 as drive means on roller conveyor 5 provides for also powering pressure devices 20, thus ensuring correct feed of blanks 3, and preventing slippage of the blanks with respect to rollers 7.

Moreover, using reconfigurable transmission assemblies, pressure devices 20 and other operating devices of machine 1 can be arranged as required on the conveying surface.

Clearly, changes may be made to machine 1 as described herein without, however, departing from the protective scope as defined in the accompanying claims.

In particular, belt 15 may be toothed or replaced by a chain; power may be transmitted to the pressure or operating devices otherwise than as described; the pressure and/or operating devices may be supported on the conveying surface otherwise than as described; and the pressure devices may be of any type, e.g. wheel as opposed to belt types.

The invention claimed is:

1. A machine (1) for producing articles (2) of sheet material from flat blanks (3), comprising a conveyor (5) with powered rollers (7) for feeding the blanks (3) along a path (P); at least one pressure device (20) for holding the blanks (3) in contact with the powered rollers (7); and at least one operating device (21, 22) which interacts with the blanks (3) to perform an operation on the blanks as the blanks travel along said path (P); characterized in that said conveyor (5) comprises a number of drive members (13) arranged along said path (P); and by comprising means (36) for connecting said pressure device (20) to one of said drive members (13).

2. A machine as claimed in claim 1, characterized by comprising a main drive (8) in turn comprising a motor (10), and an endless flexible member (15) fitted to the powered rollers (7) of said conveyor (5); and in that said drive members (13) are transmission members of said main drive (8).

3. A machine as claimed in claim 1, characterized in that said main drive (8) is a belt drive, and comprises, for each powered roller (7) of said conveyor (5), a driven pulley (12) cooperating with the belt (15) of the main drive; said drive members being defined by idle pulleys (13) of said main drive (8).

4. A machine as claimed in claim 1, characterized in that said means for connecting said pressure device to one of said drive members (36) comprise at least a first end member (42) connected to a respective said drive member (13); an end member (43) connected to a driving member (31) of said pressure device (20); an intermediate telescopic member (44); and universal joints, each interposed between the telescopic member (44) and a respective end member (42, 43).

5. A machine as claimed in claim 1, characterized by comprising a coupling (37) connectable to a respective drive member (13) and having a pulley portion (40).

6. A machine as claimed in claim 5, characterized in that said means for connecting said pressure device to one of said drive members (36) are connected to a respective drive member (13) by said coupling (37).

7. A machine as claimed in claim 5, characterized in that said operating device (22) is powered.

8. A machine as claimed in claim 7, characterized in that said operating device (22) is connected by a belt (60) to one of said drive members (13).

9. A machine as claimed in claim 8, characterized in that said belt (60) cooperates with said pulley portion (40) of a coupling (37) connected to the drive member (13).

10. A machine as claimed in claim 7, characterized in that said operating device (22) is a folding device.

11. A machine as claimed in claim 10, characterized in that said folding device (12) is a pocket folding device.

12. A machine as claimed in claim 1, characterized in that said pressure device (20) comprises a belt (33) looped about a drive pulley (31) and a driven pulley (32); a branch (34) of said belt (33) lying on a conveying surface of said conveyor (5).

13. A machine as claimed in claim 1, characterized by comprising reconfigurable supporting means (25) for supporting said at least one pressure device (20) and said at least one operating device (21) on said conveyor (5).

14. A machine as claimed in claim 13, characterized in that said reconfigurable supporting means comprise a gantry frame (26) fixable in predetermined discrete positions to fixed shoulders (6) of said conveyor (5); and a bar system (30) for suspending said pressure device (20) or operating device (21) from a cross member (28) of said gantry frame (26).

* * * * *